United States Patent [19]

Kung

[11] 4,226,728

[45] Oct. 7, 1980

[54] FIRE EXTINGUISHER AND FIRE EXTINGUISHING COMPOSITION

[76] Inventor: Shin H. Kung, 28-34-200th St., Bayside, N.Y. 11360

[21] Appl. No.: 906,409

[22] Filed: May 16, 1978

[51] Int. Cl.[2] ..... A62D 1/00

[52] U.S. Cl. ..... 252/8

[58] Field of Search ..... 252/8

[56] References Cited

U.S. PATENT DOCUMENTS

| | | | |
|---|---|---|---|
| 3,804,759 | 4/1974 | Becker et al. | 252/8 |
| 3,822,207 | 7/1974 | Howard et al. | 252/8 |
| 4,014,799 | 3/1977 | Owens | 252/8 |

FOREIGN PATENT DOCUMENTS

| | | | |
|---|---|---|---|
| 1105283 | 4/1961 | Fed. Rep. of Germany | 252/8 |
| 1241690 | 8/1971 | United Kingdom | 252/8 |

OTHER PUBLICATIONS

Research Disclosure, Jul. 1975, No. 135, pp. 45-46.

*Primary Examiner*—Leland A. Sebastian

[57] ABSTRACT

An improved fire extinguishing composition is described using two differing fire extinguishing fluids with or without the use of a nonfluorocarbon propellant. The two fire extinguishing fluids are a low vapor pressure halogenated alkane such as bromochlorodifluoromethane and a higher vapor pressure halogenated alkane such as bromotrichloromethane. The fire extinguishing composition is self propelled. Minor proportions of a propellant such as propane or carbon dioxide may be combined with the extinguishing composition for dispensing from an aerosol-type container.

8 Claims, No Drawings

FIRE EXTINGUISHER AND FIRE EXTINGUISHING COMPOSITION

BACKGROUND OF THE INVENTION

The present invention provides a fire extinguisher of conveniently small size for use in aircraft, automobiles, recreational vehicles, pleasure boats, homes and the like without requiring a fluorocarbon propellant (which may be evironmentally undesirable) or an inert gas which is characterized by a drop in dispensing pressure when it is used independently.

Typical of recent developments in fire extinguishers is one described in a patent to Owens U.S. Pat. No. 4,014,799 which states that volatile fluorohalocarbons containing bromine (such as $CBrF_3$, $CBrClF_2$, $CBr_2F_2$ and $CF_2Br$-$CF_2Br$) have now been found strikingly more effective in extiguishing fires than are the older fireinert gases. Also a U.S. Pat. No. 3,822,207 to Howard and Lomas which states that chloropentafluoroethane (a halogenated alkane without bromine) is a general purpose fire extinguishing agent of low toxicity. The problems with these prior compositions are that the containers heretofore available are not of sufficiently small size, simple, handoperable and economical to permit household use. To the extent that these problems are overcome in the extinguisher of U.S. Pat. No. 3,804,759 to Becker and Furlow, the small size fire extinguisher has all the undesirable factors of the aerosol industry product.

DESCRIPTION OF A PREFERRED EMBODIMENT

The fire extinguishing compositions of this invention comprise two types of fire extinguishing fluids. One is a low vapor pressure halogenated alkane and the other a higher vapor pressure halogenated alkane. A halogenated alkane contains one or two carbons and two or more of the members of the halogens (flourine, clorine or bromine). Table I shows the classification of halogenated alkanes by vapor pressure. A higher vapor pressure halogenated alkane may be at least partially substituted for by a non-fluorocarbon propellant, for example, propane. An inert gas additive, for example, carbon dioxide or nitrogen may be used for effective dispensing at very low temeratures, for example, −40° F.

The vapor pressure of the fire extinguishing composition will be between the vapor pressure of the low vapor pressure halon up to about 70 p.s.i.g. When an inert gas additive is used, the vapor pressure of the fire extinguishing composition is somewhat higher up to about 85 p.s.i.g.

TABLE I

| VAPOR PRESSURE OF HALONE (at 70° F.) | | |
|---|---|---|
| High Vapor Pressure Halons | | |
| Chlorotrifluoromethane | (473.4 psig) | (Halon 13) |
| Bromotrifluoromethane | (213.7 psig) | (Halon 1202) |
| Chloropentafluoroethane | (119.1 psig) | (Halon 215) |
| Low Vapor Pressure Halons | | |
| Trichlorofluoromethane | (13.345 psig) | (Halon 11) |
| Dibromodifluoromethane | (27.6 psig) | (Halon 1202) |
| Bromochlorodifluoromethane | (22.7 psig) | (Halon 1211) |
| 1,2-dibromotetrafluoroethane | (3.8 psig at 130° F.) | (Halon 2402) |

Table II gives the vapor pressure of several examples of preferred fire extinguishing compositions of the invention as follows: (1) Halon 1301 and Halon 1211; (2) Halon 215 and Halon 1211; (3) Carbon dioxide and Halon 1211; and (4) Propane and Halon 1211.

TABLE II

| VAPOR PRESSURE FIRE EXTINGUISHING COMPOSITIONS | |
|---|---|
| (1) HALON 1301 and HALON 1211: the percentage shown below is that of HALON 1301 | |
| 5% | 32.54 psig |
| 10% | 42.99 psig |
| 15% | 53.29 psig |
| 20% | 63.50 psig |
| (2) HALON 215 and HALON 1211: the percentage shown below is that of HALON 215 | |
| 10% | 32.39 psig |
| 20% | 42.50 psig |
| 30% | 52.54 psig |
| (3) Carbon dioxide and HALON 1211: the percentage shown below is that of Carbon dioxide | |
| 3% | 80. psig |
| (4) Propane and HALON 1211: the percentage shown below is that of Propane | |
| 3% | 37.5 psig |
| 5% | 49.7 psig |
| 10% | 71.41 psig |

The rate of discharge of the fire extinguishing composition increases with the increase in vapor pressure. Table III shows the role of the increased vapor pressure on the rate of discharge in grams per second at 70° F. The distance that the fire extinguishing fluid is being discharged in liquid form as measured in feet decreases with increased vapor pressure within the range defined.

TABLE III

| VAPOR PRESSURE AND RATE OF DISCHARGE (at 70° F.) | | |
|---|---|---|
| 1301 to 1211 ratio | vapor pressure | discharge rate |
| 10% vs 90% | 40 psig | 10.8 gm/sec |
| 13% vs 87% | 46 psig | 10.9 gm/sec |
| 15% vs 85% | 50 psig | 11.5 gm/sec |
| 20% vs 80% | 60 psig | 14.0 gm/sec |

Table IV shows the discharge distance of a fire extinguishing composition made up of Halon 1301 and Halon 1211.

TABLE IV

| VAPOR PRESSURE AND DISCHARGE DISTANCE (at 70° F.) (HALON 1301 and HALON 1211) | | |
|---|---|---|
| pressure | % of 1301 | discharge distance |
| 30 psig | 5 | 10 feet plus |
| 40 psig | 10 | 10 feet |
| 50 psig | 15 | 7.5 feet |
| 60 psig | 20 | 5 feet |

The fire extinguishing capability for the improved fire extinguishing solutions has been examined. For this, a metal pan 13 inches by 9 inches and providing a total surface area of 117 square inches is used. A half inch of water is first poured into the pan and is covered by a half inch of unleaded gasoline. The gasoline is allowed to burn after ignition for 3 minutes before the fire extinguishing composition is applied to the test fire.

The test was conducted at 45° F. with a wind velocity of about three miles per hour. When the operator was standing three feet from the pan on the ground, the fire extinguishing composition was dispensed at a distance of from four to five feet from the pan.

While the dispensing of other fire extinguishing agents such as dried chemicals may be more efficient with a side by side movement, the dispensing of the preferred fire extinguishing solutions is most efficient when the dispensed fluid is aimed at a certain area of the fire until that area is completely fire-freed before moving to other burning areas. Side by side movement consumed about three times as much of the fire extinguishing composition due to frequent reignition compared to the slow aimed movement.

With the slow aimed movement, the test fire was extinguished in three to four seconds using 32.5 grams to 37.5 grams of fire extinguishing composition of the 10% Halon 1301 and Halon 1211 mixture (Table II, (1)) at about 43 p.s.i.g.

Another example was a test of the fire extinguishing composition composed of five percent propane and 95 percent Halon 1211 (Table II, 4) at about 50 p.s.i.g. The test fire was extinguished in three to five seconds by dispensing 37.1 grams to 39.6 grams of this fire extinguishing composition.

The above tests used a dispensing valve with four holes in the stem each having a diameter of 0.025 inches. Other valve designs having a single larger round hole, for example, showed generally similar results.

It will be seen that an improved fire extinguishing means including a new composition has been described which is particularly suited for smaller containers without requiring extremely high container pressures. This makes the fire extinguishers not only smaller, and correspondingly more convenient, but also capable of being produced in a relatively inexpensive form. The simple extinguisher is useful for many purposes such as in the home, and in automobiles, boats and the like. In addition, the preferred fire extinguishing compositions are used without a fluorocarbon propellant and therefore avoid the environmental problems which are associated with such fluorocarbon uses. The preferred fire extinguishing compositions also are characterized by a minimal pressure drop as they are dispensed.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described my invention, I claim:

1. An improved extinguishing compound for use in low pressure, aerosol fire extinguishers consisting of between about 10 and 90% of a low vapor pressure halogenated alkane selected from the group consisting of trichlorofluoromethane, dibromodifluoromethane, bormochlorodifluoromethane and 1,2-dibromotetrafluoroethane and between about 4 and 96% of a high vapor pressure halogenated alkane selected from the group consisting of, bromotrifluoromethane, and chloropentafluoroethane, all of said percentages being by weight of the extinguishing compound.

2. The improved extinguishing compound of claim 1 wherein said low vapor pressure halogenated alkane is between about 50 and 96% and said high vapor pressure halogenated alkane is between about 4 and 50%.

3. The improved extinguishing compound of claim 1 wherein said low vapor pressure halogenated alkane is trichlorofluoromethane.

4. The improved extinguishing compound of claim 1 wherein said low vapor pressure halogenated alkane is dibromodifluoromethane.

5. The improved extinguishing compound of claim 1 wherein said low vapor pressure halogenated alkane is bromochlorodifluoromethane.

6. The improved extinguishing compound of claim 1 wherein said low vapor pressure halogenated alkane is 1,2-dibromotetrafluoroethane.

7. The improved extinguishing compound of claim 1 wherein said high vapor pressure halogenated alkane is bromotrifluoromethane.

8. The improved extinguishing compound of claim 1 wherein said high vapor pressure halogenated alkane is chloropentafluoroethane.

* * * * *

REEXAMINATION CERTIFICATE (737th)

United States Patent [19] [11] B1 4,226,728

Kung [45] Certificate Issued Aug. 4, 1987

[54] FIRE EXTINGUISHER AND FIRE EXTINGUISHING COMPOSITION

[75] Inventor: Shiu H. Kung, Bayside, N.Y.

[73] Assignee: Pat Evans, Cleveland, Tenn.

Reexamination Request:
No. 90/000,698, Dec. 21, 1984

Reexamination Certificate for:

| | |
|---|---|
| Patent No.: | **4,226,728** |
| Issued: | **Oct. 7, 1980** |
| Appl. No.: | **906,409** |
| Filed: | **May 16, 1978** |

[51] Int. Cl.[4] ..... A62D 1/00
[52] U.S. Cl. ..... 252/8
[58] Field of Search ..... 252/8, 3, 8.05; 169/30, 169/44, 46, 65, 71

[56] References Cited

U.S. PATENT DOCUMENTS

| | | | |
|---|---|---|---|
| 3,822,207 | 7/1974 | Howard et al. | 252/8 |
| 3,879,297 | 4/1975 | Languille et al. | 252/8 |
| 4,069,872 | 1/1978 | Lassen | 169/47 |

FOREIGN PATENT DOCUMENTS

| | | | |
|---|---|---|---|
| 1162198 | 1/1964 | Fed. Rep. of Germany . | |
| 1247919 | 9/1971 | United Kingdom | 252/8 |

OTHER PUBLICATIONS

Research Disclosure, Jul. 1975, No. 135, pp. 45–46.
Brochure entitled Pyroforane fire Extinguishing Agents by Ugine Kuhlman dated 6/70.
Fire Technology, "Interactions in Binary Halon Mixtures Used as Fire Suppressants"vol. 13, No. 4, Nov. 1977, by David E. Breen.

*Primary Examiner*—John F. Terapane

[57] ABSTRACT

An improved fire extinguishing composition is described using two differing fire extinguishing fluids with or without the use of a nonfluorocarbon propellant. The two fire extinguishing fluids are a low vapor pressure halogenated alkane such as bromochlorodifluoromethane and a higher vapor pressure halogenated alkane such as bromotrichloromethane. The fire extinguishing composition is self propelled. Minor proportions of a propellant such as propane or carbon dioxide may be combined with the extinguishing composition for dispensing from an aerosol-type container.

REEXAMINATION CERTIFICATE ISSUED UNDER 35 U.S.C. 307

THE PATENT IS HEREBY AMENDED AS INDICATED BELOW.

ONLY THOSE PARAGRAPHS OF THE SPECIFICATION AFFECTED BY AMENDMENT ARE PRINTED HEREIN.

AS A RESULT OF REEXAMINATION, IT HAS BEEN DETERMINED THAT:

Table 1 located at column 1, lines 54–64:

TABLE I

| VAPOR PRESSURE OF HALONE (at 70° F.) | | |
|---|---|---|
| High Vapor Pressure Halons | | |
| Chlorotrifluoromethane | (473.4 psig) | (Halon 13) |
| Bromotrifluoromethane | (213.7 psig) | [(Halon 1202)] *(Halon 1301)* |
| Chloropentafluoroethane | (119.1 psig) | (Halon 215) |
| Low Vapor Pressure Halons | | |
| Trichlorofluoromethane | (13.345 psig) | (Halon 11) |
| Dibromodifluoromethane | (27.6 psig) | (Halon 1202) |
| Bromochlorodifluoromethane | (22.7 psig) | (Halon 1211) |
| 1,2-dibromotetrafluoroethane | (3.8 psig at 130° F.) | (Halon 2402) |

Claims 1–8 are cancelled.

* * * * *